United States Patent [19]

Zeitler et al.

[11] Patent Number: 4,507,020

[45] Date of Patent: Mar. 26, 1985

[54] MINE ROOF BEARING PLATE

[75] Inventors: Louie Zeitler, Brecksville; David C. Liber, North Royalton, both of Ohio

[73] Assignee: Die-Matic Corporation, Brooklyn Heights, Ohio

[21] Appl. No.: 493,373

[22] Filed: May 10, 1983

[51] Int. Cl.[3] ..... E21D 21/00

[52] U.S. Cl. ..... 405/259; 405/303; 411/531

[58] Field of Search ..... 405/259, 260, 261, 303; 411/531, 537, 538, 544, 9-11; 52/828

[56] References Cited

U.S. PATENT DOCUMENTS

| | | | |
|---|---|---|---|
| 2,709,973 | 6/1955 | Meyer | 52/828 X |
| 3,226,934 | 5/1961 | Emery . | |
| 4,037,418 | 7/1977 | Hannan . | |
| 4,249,835 | 2/1981 | White | 405/259 |
| 4,293,243 | 10/1981 | Graybeal et al. . | |
| 4,371,293 | 2/1983 | Wilcox et al. | 405/259 |

*Primary Examiner*—Dennis L. Taylor

*Attorney, Agent, or Firm*—Yount & Tarolli

[57] ABSTRACT

An improved bearing plate is used to support a portion of a mine roof. The bearing plate is stamped from sheet metal and has elongated ribs which define grooves facing toward a back side of the bearing plate. Reinforcing members are disposed in the grooves and are fixedly connected to the bearing plate. The reinforcing members increase the resistance of the bearing plate to deflection under the influence of loads applied to the bearing plate by the mine roof.

1 Claim, 5 Drawing Figures

MINE ROOF BEARING PLATE

BACKGROUND OF THE INVENTION

The present invention relates to a bearing plate for supporting a portion of a mine roof.

When earth is dug away to form a tunnel in a mine, the earth on the upperside of the tunnel forms a roof of the mine. If this earth is not supported, it may collapse. Accordingly, it has been a common practice to use bearing plates to support the roof of a mine. Typical bearing plates are disclosed in U.S. Pat. Nos. 4,037,418 and 4,371,293. These bearing plates are pressed against the roof of the mine by bolts which extend into holes drilled in the roof of the mine.

Although it has been suggested that mine roof bearing plates could be cast in the manner shown in U.S. Pat. No. 3,226,934, mine roof bearing plates are more commonly stamped from sheet metal. In order to increase the rigidity of these sheet metal mine roof bearing plates, they have been formed with longitudinally extending ribs which increase the section modulus of the bearing plates. However, even though ribs are formed in the bearing plates, it may be necessary to form then of relatively thick sheet metal to withstand the loads applied to them by the roof of the mine.

BRIEF SUMMARY OF THE INVENTION

The present invention provides a new and improved bearing plate for use in supporting a portion of a mine roof. The bearing plate is formed of sheet metal and has elongated ribs. In accordance with a feature of the invention, reinforcing members and disposed in grooves formed by the ribs. The reinforcing members are fixedly connected to the bearing plate to increase the resistance of the bearing plate to deflection under the influence of loads applied to the bearing plate.

Accordingly, it is an object of this invention to provide a new and improved bearing plate for use in supporting a portion of a mine roof and wherein reinforcing members are fixedly connected to the bearing plate.

BRIEF DESCRIPTION OF THE DRAWINGS

The foregoing and other objects and features of the present invention will become apparent upon a consideration of the following description taken in conjunction with the accompanying drawings, wherein.

DESCRIPTION OF ONE SPECIFIC PREFERRED EMBODIMENT OF THE INVENTION

Figure 1:
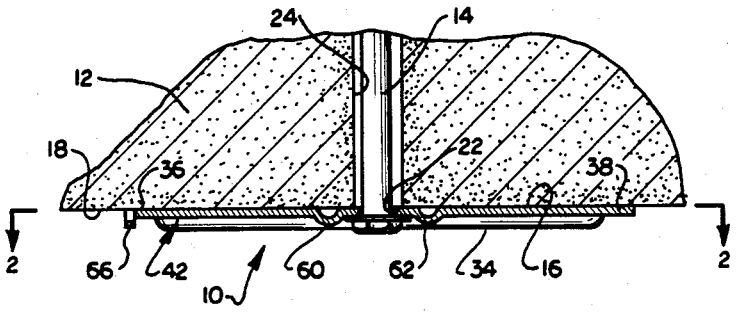
FIG. 1 is a sectional view illustrating the relationship between a bearing plate constructed in accordance with the present invention and a roof of a mine.

A bearing plate 10 constructed in accordance with the present invention is used to support a portion of a mine roof 12 (see FIG. 1). A bolt 14 presses an upwardly facing back side 16 of the bearing plate against a downwardly facing surface 18 of the mine roof 12. The bolt 14 extends through a circular opening 22 formed in the bearing plate 10 into a hole 24 drilled in the mine roof. The bolt 14 can engage an expansible anchor as shown in U.S. Pat. No. 4,100,748 or a resin anchored tubular member as shown in U.S. Pat. No. 4,132,080. However, it is preferred to have the bolt engage a mounting assembly which includes both an expansible anchor assembly and an adhesive anchor section as disclosed in U.S. patent application Ser. No. 481,400, filed Apr. 1, 1983 by Louie Zeitler and entitled "Mine Roof Bolt Mounting Assembly".

Figure 3:
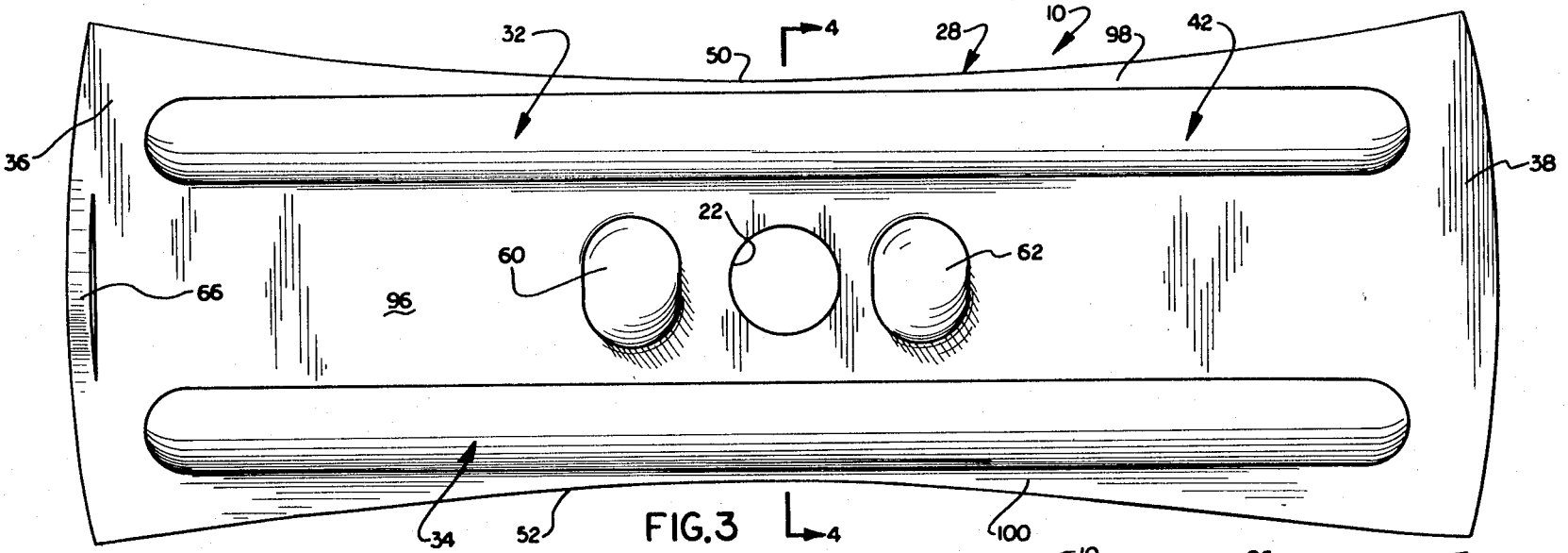
FIG. 3 is a plan view of the front side of the bearing plate of FIG. 1.
Figure 5:
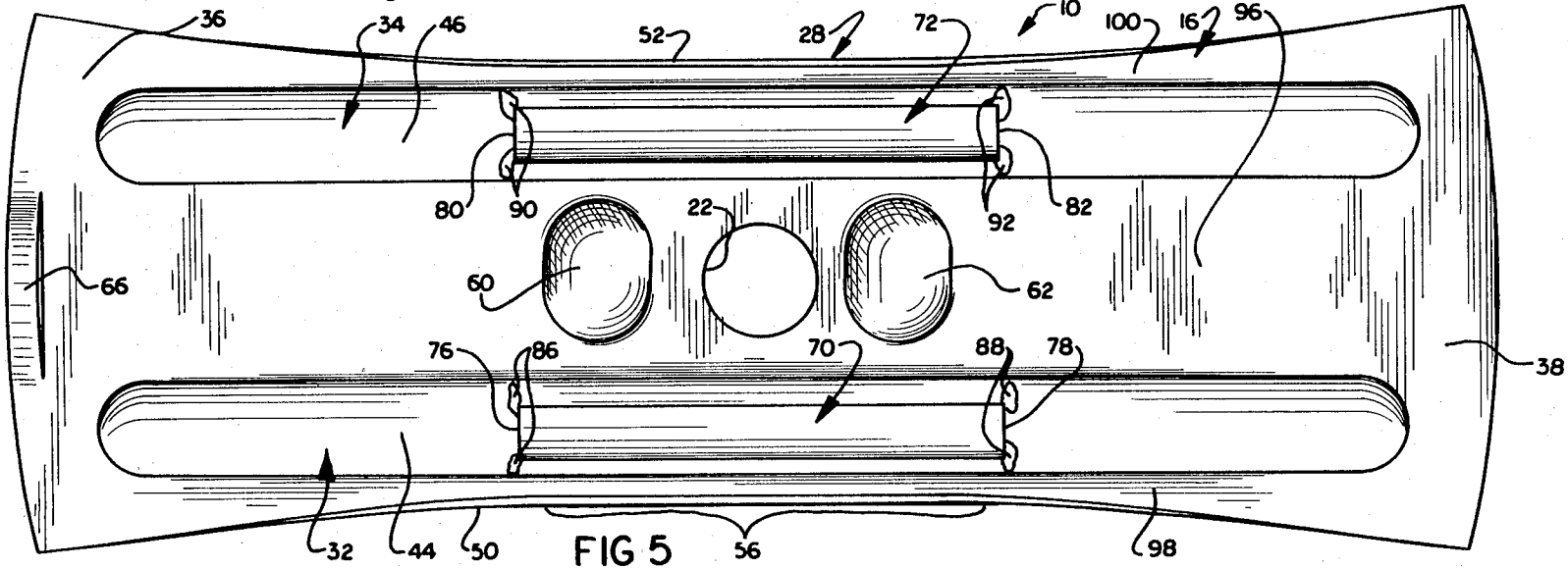
FIG. 5 is a plan view, taken generally along the line 5—5 of FIG. 4, further illustrating the manner in which the reinforcing members are connected with the back side of the bearing plate.

The bearing plate 10 is stamped from an elongated rectangular piece of sheet metal and has a generally rectangular body section 28 (see FIGS. 3 and 5). The sheet metal body section has a thickness of approximately 0.19 inches. A pair of elongated parallel ribs 32 and 34 extend to slightly flaring end portions 36 and 38 of the body section 28. However, it is contemplated that the bearing plate 10 could have a configuration other than the rectangular configuration shown in the drawings. For example, the bearing plate could have either a square or circular configuration if desired.

Figure 2:
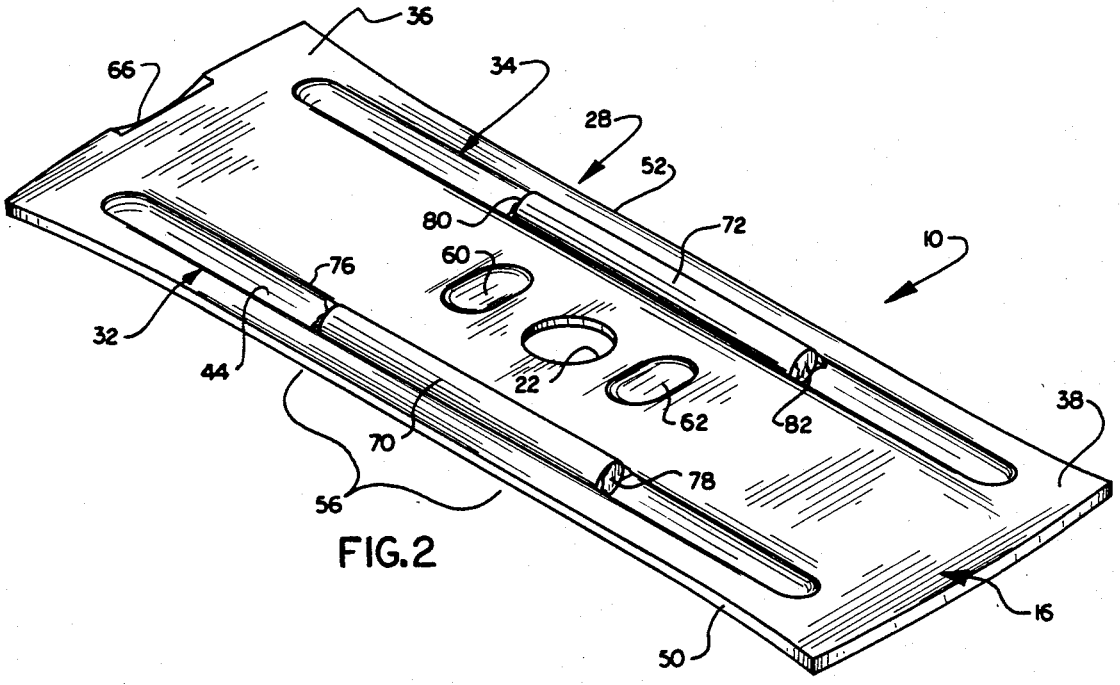
FIG. 2 is a pictorial illustration, taken generally along the line 2—2 of FIG. 1, illustrating the manner in which a pair of reinforcing members are connected with the back side of the bearing plate.

The ribs 32 and 34 are stamped in the sheet metal of the bearing plate 10 to increase the section modulus of the bearing plate so that it can better withstand the loads applied to it by the mine roof 12 (FIG. 1). The straight ribs 34, 36 project outwardly from a downwardly facing (as viewed in FIG. 1) front side 42 of the bearing plate 10. This results in the formation of elongated parallel grooves 44 and 46 in the back side 16 of the bearing plate 10 (see FIGS. 2, 4 and 5). The ribs 32 and 34 extend generally parallel to the longitudinal extending edges 50 and 52 of the bearing plate 10 (see FIGS. 3 and 4). It should be understood that the configuration of the ribs 32 and 34 could be different than the illustrated configuration.

The ribs 32 and 34 are disposed on opposite sides of the opening 22 and increase the transverse section modulus of a central portion 56 (see FIGS. 2 and 5) of the body section 28 of the bearing plate 10. The central portion 56 of the bearing plate 10 tends to be highly stressed by the application of mine roof loads to the bearing plate. The section modulus of the central portion 56 is further increased by the formation of dimples or secondary ribs 60 and 62 in the central portion of the bearing plate.

A hanger 66 projects downwardly (as viewed in FIG. 1) from the end portion 36 of the bearing plate 10. The hanger 66 is provided to facilitate the hanging of cables beneath the roof 12 of the mine.

In accordance with a feature of the present invention, a pair of reinforcing bars or members 70 and 72 (see FIGS. 2 and 5) are provided in the grooves 44 and 46 to increase the resistance of the bearing plate 10 to deflection under the influence of loads applied to the bearing plate by the mine roof 12. Thus, the reinforcing member 70 is disposed in the groove 44 formed in the back side of the rib 32. The reinforcing member 72 extends generally parallel to the reinforcing member 70 and is disposed in a groove 46 formed in the back side of a rib 34.

The reinforcing members 70 and 72 are disposed on opposite sides of the opening 22 in the relatively highly stressed central portion 56 of the bearing plate 10. Thus, the reinforcing members 70 and 72 compensate for the material which is removed from the highly stressed central portion 56 of the bearing plate 10 by the formation of the opening 22. In addition, the reinforcing members 70 and 72 increase the section modulus of the portion of the bearing plate which is subjected to relatively large bending moments by the weight of the mine roof 12 on the end portions 36 and 38 of the bearing plate 10.

To enhance the load carrying capabilities of the bearing plate 10, the reinforcing members 70 and 72 extend through the central portion 56 of the bearing plate 10 past the secondary ribs 60 and 62. Thus, the ends 76 and 78 of the reinforcing member 70 are disposed outwardly of the central portion 56 so that the reinforcing member 70 extends through the central portion past the two secondary ribs 60 and 62. Similarly, the reinforcing member 72 has end portions 80 and 82 disposed on opposite sides of the central portion 56 so that the reinforcing member 72 extends through the central portion 56 past the secondary ribs 60 and 62 (see FIG. 5).

The reinforcing members 70 and 72 are fixedly connected to the back side 16 of the bearing plate 10. To this end, welds 86 and 88 connect the reinforcing member 70 with the back side 16 of the bearing plate 10 (see FIG. 5). Similarly, welds 90 and 92 connect the reinforcing member 72 with the back side of the bearing plate 10. Although the welds 86, 88, 90 and 92 are disposed at the ends of the reinforcing members 70 and 72, it is contemplated that the welds could be formed at selected locations along the length of the reinforcing members. In fact, the reinforcing members 70 and 72 could be welded to opposite sides of the grooves 32 and 34 throughout their length if desired.

The extent to which reinforcing members, similar to the reinforcing members 70 and 72, increase the load carrying capabilities of a particular bearing plate will depend upon many different factors. However, in one specific instance, an unreinforced bearing plate of the same general construction as the bearing plate 10 was capable of withstanding a load of approximately 20,000 pounds without deflecting more than 0.250 of an inch. This load was applied by a 1.75 inch diameter punch to the central portion of an unreinforced bearing plate extending across a 4 inch opening. When the bearing plate was reinforced with the members 70 and 72, in the manner shown in FIGS. 2, 4 and 5, the bearing plate was capable of withstanding a load in excess of 30,000 pounds, applied in the same manner, without deflecting more than 0.250 of an inch.

Figure 4:
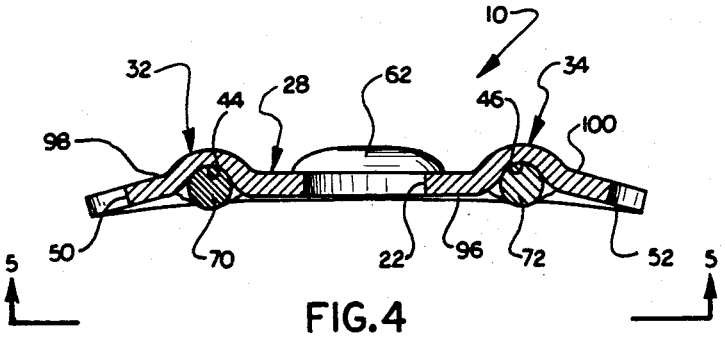
FIG. 4 is a sectional view, taken generally along the line 4—4 of FIG. 3, illustrating the manner in which a pair of reinforcing members are disposed in grooves formed by ribs in the bearing plate.

A generally rectangular body section 28 of the bearing plate 10 has a generally flat section 96 (see FIG. 4) which extends between the two ribs 32 and 34. Longitudinally extending edge portion 98 and 100 of the body section 28 are disposed outwardly of the ribs 32 and 34 (FIG. 4). The edge portions 98 and 100 slope away from the ribs 32 and 34 toward the back side 16 of the bearing plate 10 so that when the bearing plate is disposed in engagement with a mine roof 12 (see FIG. 1), the edge portions 98 and 100 are pressed into the mine roof. This enables the edge portions 98 and 100 to hold the bearing plate 10 against sidewise movement or rotation under the influence of sidewardly directed loads applied to the bearing plate and/or during rotation of the mine roof bolt 14.

The slope of the edge portions 98 and 100 relative to the central portion 96 of the body section 28 tends to increase the section modulus and rigidity of the body section of the bearing plate 10. It should be noted that the end portions 36 and 38 of the bearing plate are generally flat to provide a relatively wide load bearing area at the outer ends of the bearing plate 10.

The reinforcing members 70 and 72 project out of the grooves 44 and 46 formed in the ribs 32 and 34 (FIG. 4). Thus, the reinforcing member 70 and 72 have a cylindrical configuration and are disposed in the grooves 44 and 46 which have a generally semi-circular cross sectional configuration. This results in the reinforcing members 70 and 72 engaging the mine roof 12 so that they cooperate with the sloping edge portions 98 and 100 to firmly grip the material of the mine roof and hold the bearing plate 10 against sidewise or rotational movement about the central axis of the mine roof bolt 14.

Although it is preferred to use reinforcing members having a cylindrical configuration, it is contemplated that the reinforcing members could have a different configuration if desired. If the ribs used on the bearing plate have a nonlinear configuration, for example, circular, the reinforcing members would have a similar nonlinear configuration.

In view of the foregoing description, it is apparent that the present invention provides a new and improved bearing plate 10 for use in supporting a portion of a mine roof 12. The bearing plate 10 is formed of sheet metal and has elongated ribs 32 and 34. In accordance with a feature of the invention, reinforcing members 70 and 72 are disposed in grooves 44 and 46 formed by the ribs. The reinforcing members 70 and 72 are fixedly connected to the bearing plate 10 by welds 86–92 to increase the resistance of the bearing plate to deflection under the influence of loads applied to the bearing plate.

Having described one specific preferred embodiment of the invention, the following is claimed:

1. A bearing plate for use in supporting a mine roof, said bearing plate comprising an elongated sheet metal body section having a first side adapted to face toward the mine roof and a second side adapted to face away from the mine roof, said body section having a pair of longitudinally extending edge portions, a central portion disposed between said edge portions, and a pair of elongated ribs extending across the central portion of said body section and generally parallel to said edge portions, each of said ribs defining an elongated groove in said first side of said body section, said body section including surface means for defining an opening formed in the central portion of said body section between said ribs to enable a mine roof bolt to extend through said bearing plate, a pair of reinforcing members disposed in said grooves on opposite sides of said opening and extending across the central portion of said body section, and means for fixedly connecting each of said reinforcing members to said body section of said bearing plate to increase the resistance of said bearing plate to deflection under the influence of loads applied to said bearing plate, each of said reinforcing members having a first end portion which is disposed on one side of the central portion of said body section, a second end portion which is disposed on a second side of the central portion of said body section, and a midportion which spans the central portion of said body section.

* * * * *